US007055466B2

(12) United States Patent
Long

(10) Patent No.: US 7,055,466 B2
(45) Date of Patent: Jun. 6, 2006

(54) CONTROL SYSTEM FOR A PORTABLE INSTANT HOT WATER HEATER

(75) Inventor: Norris Richard Long, Wichita, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 10/376,912

(22) Filed: Feb. 28, 2003

(65) Prior Publication Data

US 2004/0170408 A1 Sep. 2, 2004

(51) Int. Cl.
*F24H 1/06* (2006.01)

(52) U.S. Cl. ..... 122/40; 122/DIG. 10; 126/344; 392/444

(58) Field of Classification Search ..... 122/13.01, 122/13.3, 14.31, 40, DIG. 10; 392/441, 392/444, 447; 126/344, 380.1, 357.1; 137/505, 137/506, 507, 613; 251/148
See application file for complete search history.

(56) References Cited

U.S. PATENT DOCUMENTS

| | | | | |
|---|---|---|---|---|
| 1,037,905 | A | | 9/1912 | Hayes |
| 1,549,835 | A | | 8/1925 | Hill |
| 3,192,916 | A | | 7/1965 | Vitkay |
| 3,291,112 | A | | 12/1966 | Springer |
| 3,545,426 | A | | 12/1970 | Escaldi |
| 3,597,588 | A | | 8/1971 | Kirschner et al. |
| 3,687,128 | A | | 8/1972 | Williams |
| 3,709,198 | A | | 1/1973 | Williams |
| 3,730,165 | A | | 5/1973 | Williams |
| 3,738,351 | A | | 6/1973 | Watts |
| 3,741,195 | A | * | 6/1973 | Ellis ..... 4/638 |
| 3,763,848 | A | | 10/1973 | Williams |
| 3,768,458 | A | | 10/1973 | Williams |
| 4,136,731 | A | | 1/1979 | DeBoer |
| 4,151,862 | A | | 5/1979 | Ueda et al. |
| 4,236,548 | A | | 12/1980 | Howard |
| 4,246,764 | A | | 1/1981 | Papadakos |
| 4,287,879 | A | | 9/1981 | Roark |

(Continued)

FOREIGN PATENT DOCUMENTS

| | | |
|---|---|---|
| DE | 538 361 | 11/1931 |

(Continued)

OTHER PUBLICATIONS

Copy of Invitation to Pay Additional Fees with partial international search (Annex) by the EPO (Oct. 28, 2003).

(Continued)

*Primary Examiner*—Gregory Wilson
(74) *Attorney, Agent, or Firm*—Leydig Voit & Mayer, Ltd.

(57) ABSTRACT

A portable instant water heater. Water is delivered to a base unit of the instant hot water heater by a pump that draws water from a reservoir through a flow control valve. The water flows into a pre-heater that wraps around a base of the burner and that is heated by the burner. Water is heated in a heat exchanger and then exits the base unit through an outlet spout that swings out from the base unit to dispense water and that may be stored and locked into position in a handle for the base unit. The flow control valve may lower the flow of water through the heat exchanger, so the water has more time to absorb heat and to get hotter. The base unit includes a single control knob that turns on the pump and the burner and operates the flow control valve.

7 Claims, 12 Drawing Sheets

U.S. PATENT DOCUMENTS 4,315,729 A * 2/1982 Tanaka et al. ..... 431/75
4,392,609 A 7/1983 Conterio
4,429,682 A 2/1984 Huang
4,480,631 A 11/1984 Kristensen
4,501,261 A 2/1985 Tsutui et al.
4,550,689 A 11/1985 Wolter
4,558,207 A 12/1985 Litterst
4,583,495 A 4/1986 Hill et al.
4,771,762 A 9/1988 Bridegum
4,811,870 A 3/1989 Bianco
4,826,594 A 5/1989 Sedman
4,947,025 A 8/1990 Alston et al.
4,948,947 A * 8/1990 Kang ..... 392/386
4,994,959 A * 2/1991 Ovenden et al. ..... 700/33
5,105,799 A 4/1992 Wigdahl
5,174,331 A * 12/1992 Steudler, Jr. ..... 137/505.46
5,201,651 A 4/1993 Niksic et al.
5,208,520 A * 5/1993 Sawato et al. ..... 318/551
5,220,877 A * 6/1993 Redovian ..... 112/237
5,277,343 A 1/1994 Parsonage
5,313,914 A 5/1994 Woollen
5,385,298 A 1/1995 Griggs
5,460,161 A * 10/1995 Englehart et al. ..... 126/344
5,524,820 A 6/1996 Regan
5,606,964 A 3/1997 Bussman
5,772,405 A * 6/1998 Eller ..... 417/233
5,775,267 A 7/1998 Hou et al.
5,785,067 A * 7/1998 Kosofsky ..... 134/102.1
6,106,494 A * 8/2000 Saravia et al. ..... 604/35
6,152,083 A 11/2000 Bridegum
6,152,707 A * 11/2000 Alberg ..... 417/423.3
6,302,094 B1 10/2001 Wehrly et al.
6,354,511 B1 * 3/2002 Hardee ..... 237/19
6,374,853 B1 * 4/2002 Callies ..... 137/495
6,470,836 B1 * 10/2002 Manley et al. ..... 122/40
6,628,894 B1 * 9/2003 Winter et al. ..... 392/447
6,644,929 B1 * 11/2003 Duggan et al. ..... 417/38
6,877,461 B1 * 4/2005 Long et al. ..... 122/14.1
2001/0047541 A1 12/2001 Johns
2004/0031449 A1 2/2004 Long et al.

FOREIGN PATENT DOCUMENTS

FR 2 542 854 A 9/1984
GB 2 289 323 A 11/1995
GB 2 341 667 A 3/2000

OTHER PUBLICATIONS

Copy of Invitation to Pay Additional Fees with partial international search by the EPO (Jul. 17, 2004).

* cited by examiner

CONTROL SYSTEM FOR A PORTABLE INSTANT HOT WATER HEATER

TECHNICAL FIELD OF THE INVENTION

The present invention is directed to an instant hot water heater, and more specifically, a portable instant hot water heater.

BACKGROUND OF THE INVENTION

Camping and tailgating are popular recreational activities enjoyed by many. Some people camp so that they may enjoy the outdoors, and others use camping as an inexpensive alternative to staying in hotels. Tailgating is a great way to meet and eat before ball games, and has become quite the ritual for many season ticket holders.

Although many campers enjoy being in the outdoors, often campers like to enjoy the luxuries of home while camping. For example, many campers bring lounge chairs or hammocks, portable air mattresses or cots, and similar items to make a camping experience more comfortable. Similarly, people often like to enjoy home luxuries while tailgating.

One item that most campers and tailgaters have to learn to do without is the availability of hot water. Most homes are equipped with running hot water, supplied by a hot water heater that is connected with the home plumbing. The user simply turns on a faucet, and after a short delay, hot water is supplied. The hot water may be used for bathing, cleaning, cooking, or washing clothes.

In a camping or tailgating environment, if a user desires hot water, the user must obtain water, for example, from a faucet or other water source, and place the water in a container over a fire, such as a camp stove or an open fire. The water must then be heated to a desired temperature. This process typically takes several minutes, and water temperatures that are obtained using this process are relatively imprecise. The water that has been heated is hard to dispense because it is in a heated pot and the pots often are not designed for pouring. Also, if a user desires a lot of heated water, the process must be repeated until enough hot water is produced. Moreover, a user risks overheating the water to a point where it is dangerous to handle, especially for children.

In practice, because the process for preparing and obtaining heated water is so difficult when camping or tailgating, most users typically wash dishes, prepare food, and wash their face and hands with unheated water. Typically, the users will heat water only as necessary for food preparation and for making instant coffee and tea, for example.

SUMMARY OF THE INVENTION

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

The present invention provides an instant water heater that utilizes a flame, for example, produced by a propane burner. The instant hot water heater is fully portable, and may be used, for example, in camping or tailgating environments. The instant hot water heater is configured to deliver varying degrees of hot water, for example ranging from 90° to 150°, instantaneously. The hot water heater is designed to operate regardless of the temperature of source water. Hot water from the instant hot water heater may be used for many applications, including but not limited to, washing dishes, food preparation, making coffee and tea, and washing face and hands.

Water is delivered to a base unit of the instant hot water heater by a pump that is attached to the base unit by a hose. The pump may draw water from a reservoir or other water source. Alternatively, water may be provided by a conventional hose or another water source.

The base unit includes a burner and a fuel source, such as a propane cylinder. A conventional battery operated igniter, such as is used for barbeque grills, may be provided for lighting a flame in the burner.

The pump delivers water to the base and into and through a flow control valve. From the flow control valve, the water flows into a pre-heater and then into a heat exchanger. The pre-heater includes a structure that wraps around a base of the burner and that is heated by the burner. This structure heats the water prior to the water entering the heat exchanger, increasing efficiency of the water heating process, and reducing the possibility of condensation being formed at the heat exchanger.

The heat exchanger is heated by the burner, and the water flows through coils that are embedded in the heat exchanger. Water exiting the heat exchanger is heated to a temperature that is ready for use.

Water exits the base unit through an outlet spout that resembles a kitchen faucet spout. The spout swings out from the base unit to dispense water. The spout may be stored and locked into position in a handle for the base unit, and may be swung out for use.

A flow control system controls the amount of water flowing through the base unit so that the water may be heated to a desired level for a user. By lowering the flow of water through the heat exchanger, the water has more time to absorb heat and to get hotter.

The base unit includes a single control knob that turns on the pump and the burner and operates the flow control valve. In a first portion of movement of the control knob (e.g., a first quarter-turns of the control knob), the pump and a control circuit for the base unit are turned on. In a second portion of movement of the control knob (e.g., a second quarter-turn of the control knob), the burner is turned on. Further movement in the second portion adjusts the output of the burner. The burner reaches full output at the end of the second portion. At a third portion of movement of the control knob (e.g., a third quarter-turn of the control knob), the burner remains at the highest output setting, but the flow control valve is adjusted to reduce the flow of water. The reduced flow of water allows the water to absorb more heat, raising the temperature of the water. In this manner, adjusting the single control knob provides a range of temperatures for the output water depending upon how much the control knob has been turned.

The base unit also includes an over temperature circuit that has a sensing element and a solenoid. The sensing element, which may be a thermistor, sends a signal to the solenoid as a result of the water exceeding a particular temperature. This condition may occur, for example, if water is no longer being supplied by the pump (i.e., the reservoir is empty.) As a result of the signal, the solenoid shuts off fuel to the burner, preventing boiling water from exiting the spout. Other safety devices may be employed, such as a device for sensing the tilt of the base unit and shutting off the burner as a result of too much tilt, a flow sensing switch that shuts off the burner if there is no or low water flow, or a flame control that senses the presence of a flame in the burner, and absent such a flame, cuts fuel to the burner.

The instant hot water heater of the present invention is fully portable, and may be used in remote locations, such as for camping or for tailgating. Its function and operation are very easy to understand, and setting up the unit takes a minimal amount of time.

In accordance with another aspect of the present invention, the controls for the instant hot water heater may include an oxygen sensor, which determines whether or not oxygen in the air adjacent to the instant hot water heater is undesirably low. This feature prevents prolonged use of the instant hot water heater in an enclosed area, and precludes a user from being in an oxygen depleted environment created by the instant hot water heater.

The instant hot water heater may additionally include a foot switch for controlling operation of the instant hot water heater. The foot switch permits hands-free operation of the instant hot water heater, for example when a user desires to wash his or her hands, or needs both hands free for the filling of a pot or for the washing of dishes, for example.

The instant hot water heater of the present invention may additionally include a garden hose adapter that permits operation of the instant hot water heater without a water reservoir and the pump. The garden hose adapter may be attached to a conventional garden hose or a water faucet and includes a regulator or other flow control device to monitor the flow of water into the instant hot water heater, and may additionally include a solenoid valve or other device for stopping and starting the flow of water into the instant hot water heater.

Other advantages will become apparent from the following detailed description when taken in conjunction with the drawings, in which:

DETAILED DESCRIPTION

In the following description, various aspects of the present invention will be described. For purposes of explanation, specific configurations and details are set forth in order to provide a thorough understanding of the present invention. However, it will also be apparent to one skilled in the art that the present invention may be practiced without the specific details. Furthermore, well-known features may be omitted or simplified in order not to obscure the present invention.

Figure 1:
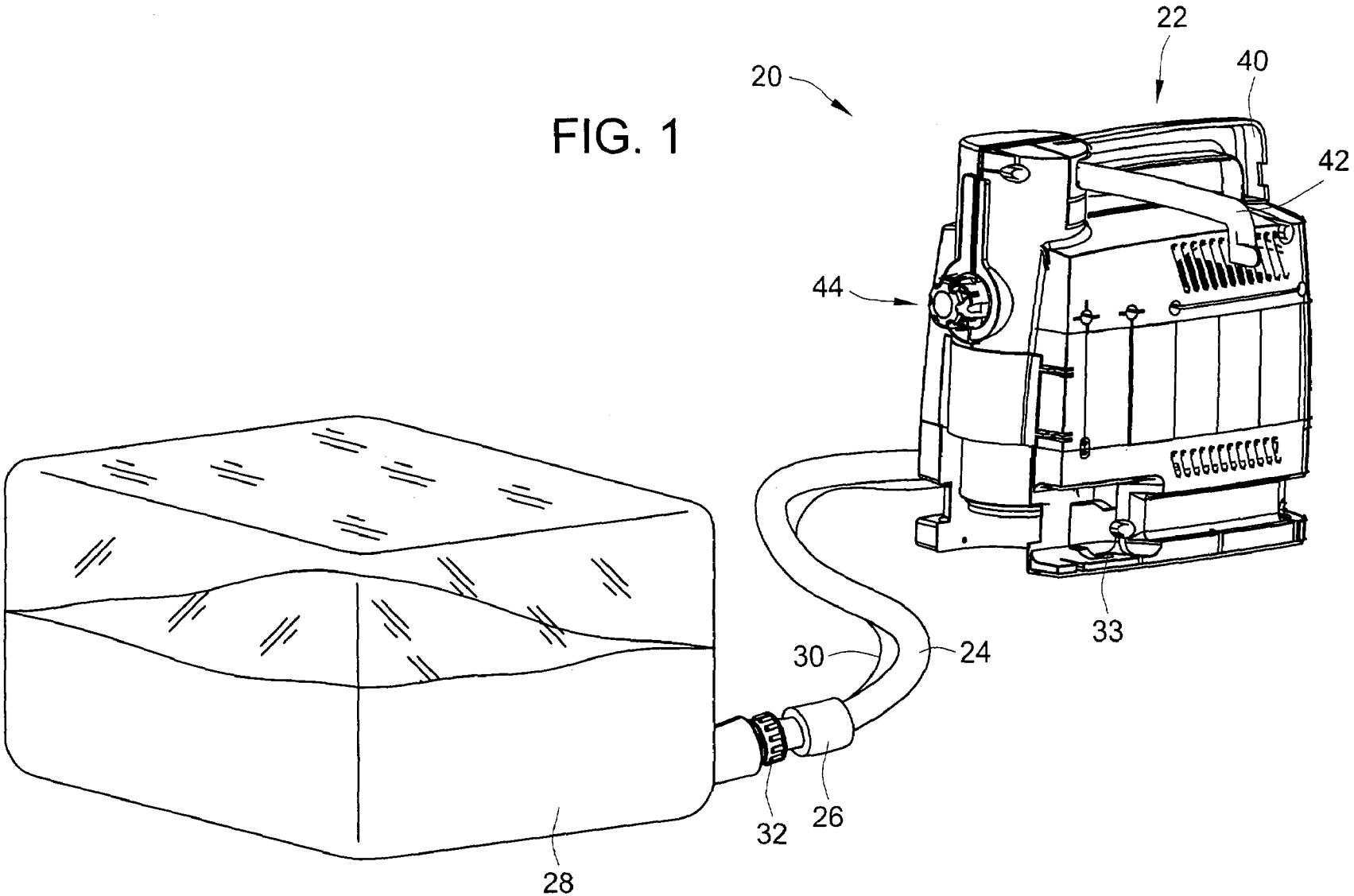
FIG. 1 is an isometric view showing an instant hot water heater in accordance with the present invention, with a spout for a base unit of the instant hot water heater extending outward, and a pump for the instant hot water heater connected to a water reservoir.

Referring now to the drawings, in which like reference numerals represent like parts throughout the several views, FIG. 1 shows an instant hot water heater 20 in accordance with the present invention. The instant hot water heater 20 includes a base unit 22 attached by a hose 24 to a pump 26. In the embodiment shown, the pump 26 is attached to a reservoir 28. A wire 30 extends between the pump 26 and the base unit 22 for providing power to the pump. For the embodiment shown, a coupling 32 is provided at a distal end of the pump 26 for attaching the pump 26 to the reservoir 28.

In operation, as further described below, the pump 26 draws water from the reservoir 28 through the hose 24 and into the base unit 22. The base unit 22 heats the water and provides the heated water at an outlet, for example, a spout 42.

Figure 2:
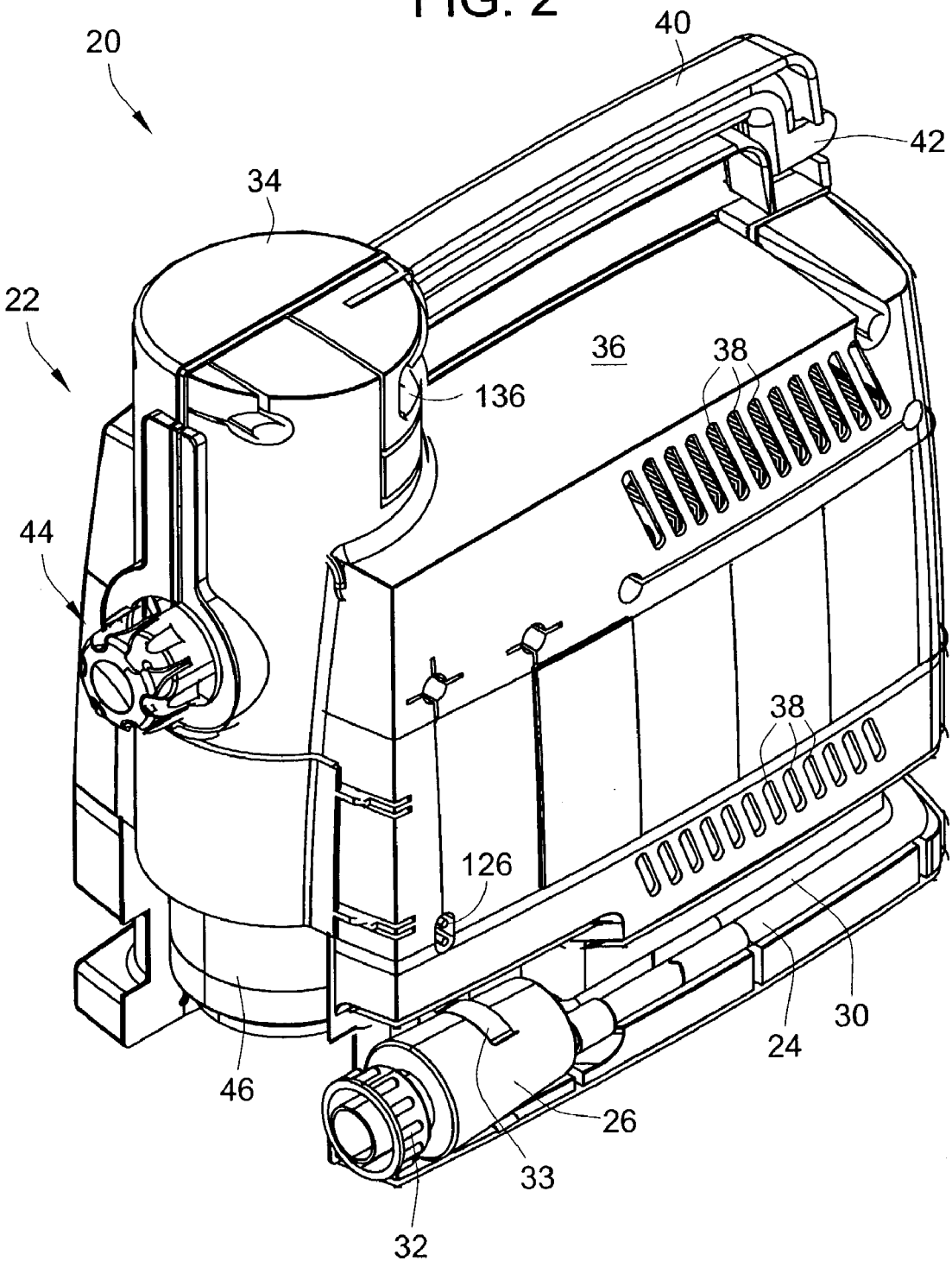
FIG. 2 is a front right isometric view of the instant hot water heater of FIG. 1, showing the pump and the spout in storage positions.

To store the instant hot water heater 20, as shown in FIG. 2, the hose 24 may be wrapped around the bottom portion of the base unit 22, and the pump 26 may be snapped onto a snap ring 33. The spout 42 is pressed into a handle 40 for the base unit 22, as is further described below.

The pump 26 and the reservoir 28 may alternatively be replaced by a conventional water hose or another water source that provides a flow of water. If a water hose is used, a regulator or other flow control device may be needed to control the flow of water into the base unit.

Figure 12:
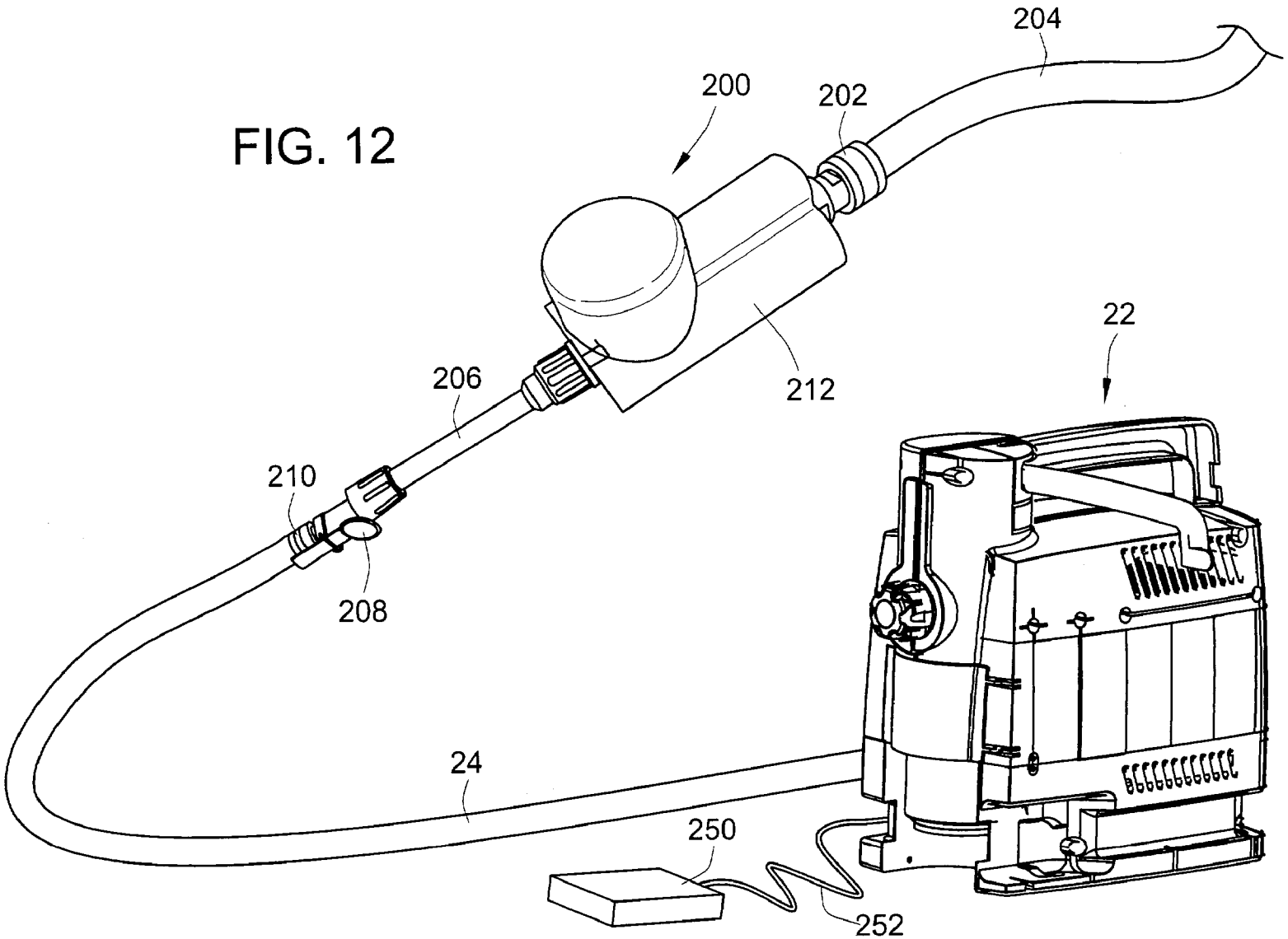
FIG. 12 is a perspective view of the instant hot water heater of FIG. 1, shown attached to a garden hose adapter.
Figure 13:
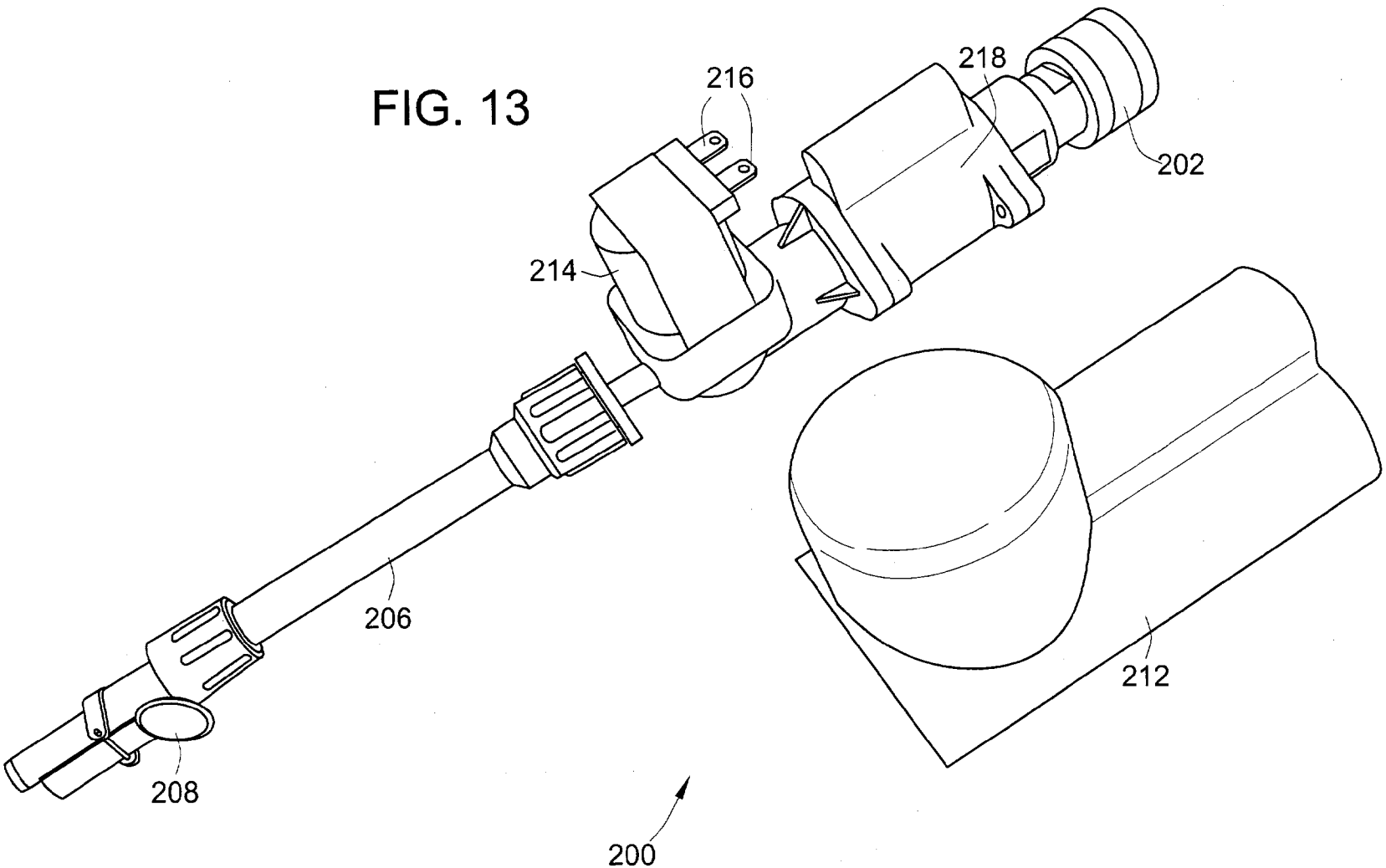
FIG. 13 is a side perspective view of the garden hose adapter of FIG. 12, with a cover removed to show detail.

An example of a garden hose adapter 200 is shown in FIGS. 12 and 13. The garden hose adapter 200 includes a coupling 202 for attaching to a garden hose 204 or a conventional water faucet (not shown). A stem 206 extends from the opposite side of the garden hose adapter 202 and includes a clip 208 on its distal end. In use, the stem 206 may be inserted into the hose 24, and the clip 208 may be extended over or behind a ring 210 or other protrusion on the hose 24.

To attach the stem 206 to the hose 24, a user presses a pad on the clip 208, causing a distal end of the clip 208 to move against the bias of a spring (not shown) The stem 206 is then inserted, and the pad of the clip 208 is released, causing a protrusion on the clip 208 to extend behind or over the ring 210.

The garden hose adapter 200 may be, therefore, attached in place of the pump 26. Alternatively, the hose 24 may be removed, and the stem 206 may be attached directly to the base unit 22.

The garden hose adapter 200 includes a cover 212, which is removed to show detail in FIG. 13. The garden hose adapter 200 includes a solenoid valve 214 which is configured and arranged to close the flow of water through the garden hose adapter 200. The solenoid valve 214 includes power prongs 216 which may be connected to a power line (not shown) attached to the base unit 22, or may utilize power provided via the wire 30.

The garden hose adapter 200 also includes a regulator 218 which is configured in a manner known in the art to lower the pressure of water from the garden hose 204 to a usable pressure for the base unit 22, in one embodiment to a water pressure of 4 p.s.i. Alternatively, the regulator 218 may be replaced with a flow control device or another mechanism that may control the flow of water and the pressure of water into the base unit 22.

The garden hose adapter 200 permits flexibility in the supply of water for the base unit 22. Instead of the pump 26 and the water reservoir 28, the garden hose adapter 200 may be used with the base unit 22 and a supply of water from a garden hose (e.g., the garden hose 204). As such, the user does not have to continually refill the reservoir [water reservoir 28?] for the production of a large amount of heated water. In addition, the garden hose adapter 200 allows the base unit 22 to be used in an outdoor home setting, such as to fill a small swimming pool. The base unit 22 includes left and right outer casings 34, 36 that fit together in a clam shell fashion. The right outer casing 36 is shown removed in FIG. 3 so that details of the internal components of the base unit 22 may be seen.

Vents 38 (FIG. 2) are provided outside of the base unit 22 for allowing heat to escape the unit. The handle 40 is integrated into the top portion of the base unit. The handle 40 extends horizontally along the top of the base unit 22, and is attached at front and rear sections of the base unit. The spout 42 may be stored in a cavity that extends the length of the handle. The spout 42 is hollow and is rotatably mounted at one end to the base unit 22. As can be seen in FIG. 1, the spout may be rotated out so that it is accessible for dispensing heated water from the base unit 22.

A control knob 44 is located on the front of the base unit 22. The control knob 44 is configured so that it controls operation of the instant hot water heater 20. As further described below, the control knob 44 is capable of turning on the pump 26 and other components of the instant hot water heater, and controlling the water output temperature of the base unit 22.

Figure 3:
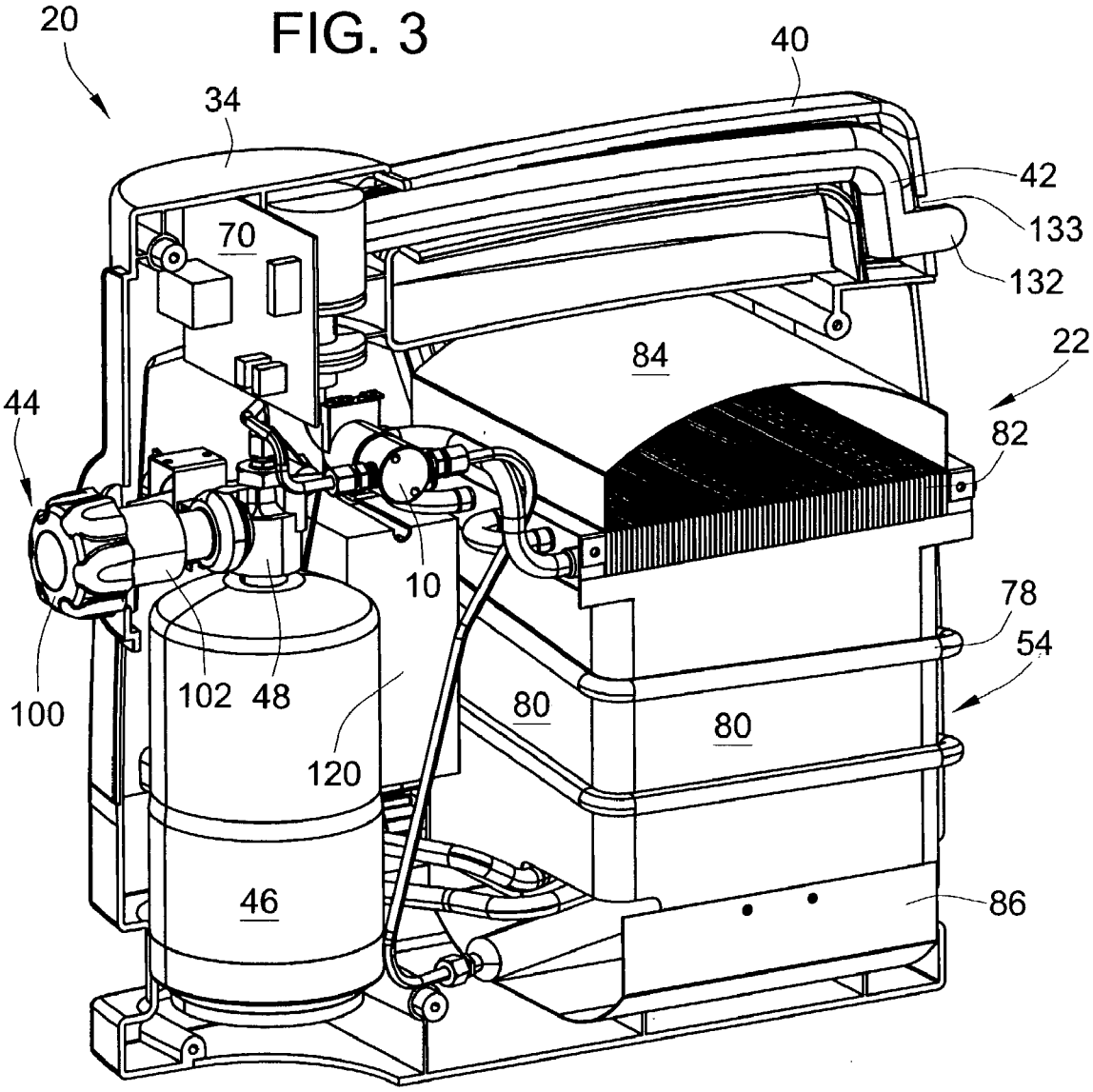
FIG. 3 is a front right, isometric view of the instant hot water heater of FIG. 1, with parts removed for detail.

Turning now to FIG. 3, a propane tank 46, such as a 16.4 oz. COLEMAN brand propane cylinder, is mounted inside the base unit 22. The propane tank 46 is threaded into the bottom of a regulator 48. The regulator 48 controls the flow of fuel from the propane tank 46 to a solenoid valve 50. The regulator 48 includes female threads (not shown) for fitting onto the threaded top of the propane tank 46. The regulator 48 is designed in a manner known in the art to control the amount of propane exiting the propane tank 46. Fuel released by the regulator 48 flows through the solenoid valve 50 to a burner 52, best shown in FIG. 5. The burner 52 provides the flame for a heat exchanger assembly 54 (FIG. 3).

The solenoid valve 50 is in a normally closed position, and is connected to a printed circuit board 70. The printed circuit board 70 includes necessary controls to instruct the solenoid valve 50 to open, as further described below.

Figure 5:
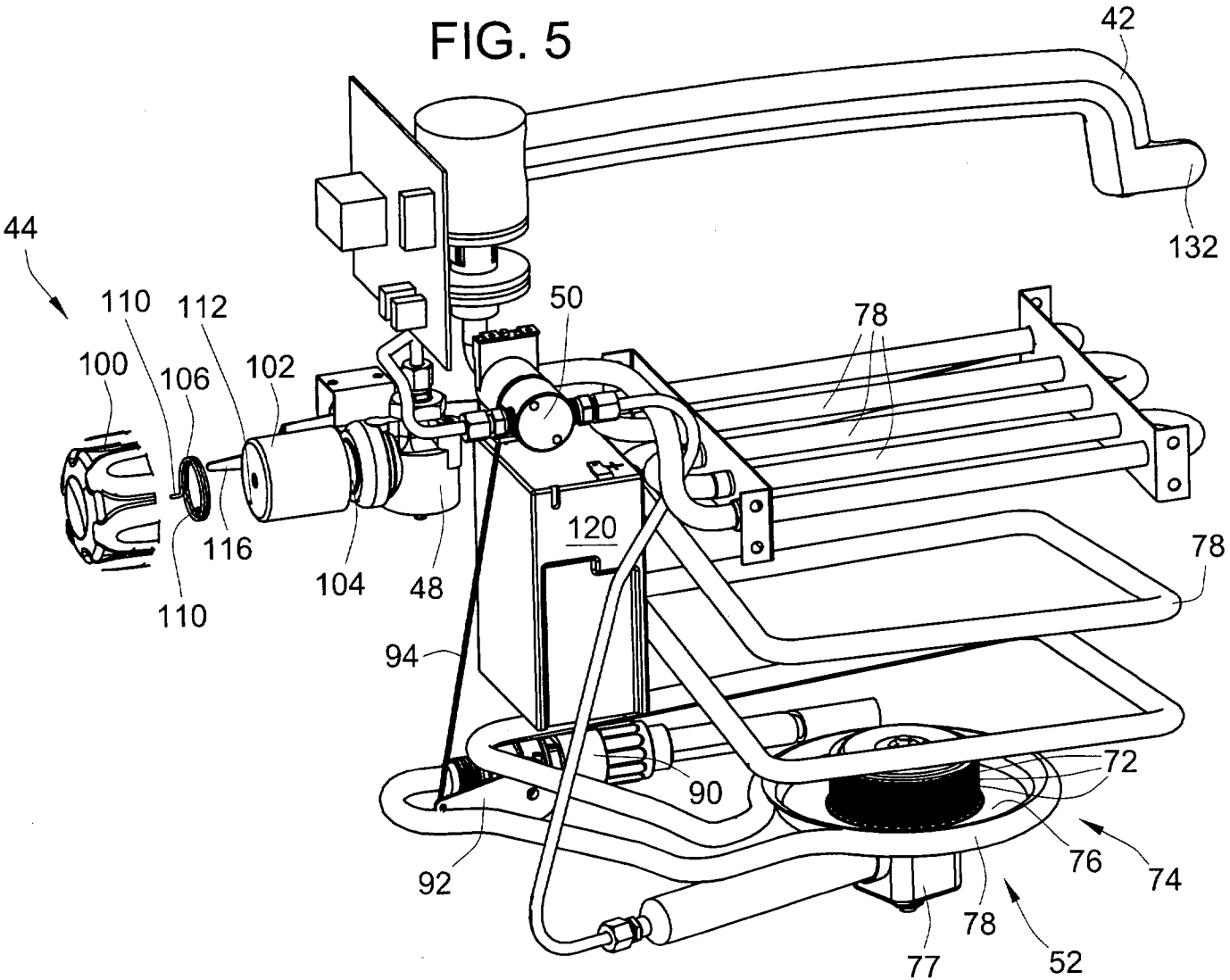
FIG. 5 is a right front, isometric view of the some internal components of the instant hot water heater of FIG. 1.

The burner 52 includes burner rings 72 (FIG. 5). Extra burner rings 72 may be provided to provide a higher Btu output and to keep noise level to a minimum. For example, the burner rings 72 may be stacked 3 times higher than in a conventional camp stove so as to allow higher heat output.

A pre-heater assembly 74 is provided that is attached to the burner 52. The pre-heater assembly 74 includes a copper plate 76 that is placed between the burner rings and a burner base 77. Although described as copper, the copper plate 76 may be formed of another suitable conductive material.

The copper plate 76 is surrounded by conductive tubing 78. The conductive tubing 78 may be, for example a ⅜" diameter copper tube.

The heat exchanger assembly 54 includes sides 80 (FIGS. 3 and 4) that extend up and around the burner 52. A heat exchanger 82 having heating fins is mounted at the top of the sides 80. An upper heating shield 84 extends over the heat exchanger 82. A lower heating shield 86 extends around a bottom of the heat exchanger assembly 54 and under the burner 52.

The routing of the conductive tubing 78 is shown in FIG. 5. The walls of the heat exchanger assembly 54 and the fins of the heat exchanger 82 have been removed to show detail. One end of the conductive tubing 78 extends from the pre-heater assembly 74 around the walls or sides 80 of the heat exchanger assembly 54 (shown wrapping around these walls in FIGS. 3 and 4) and into the heat exchanger 82. The conductive tubing 78 then makes a circuitous path through the heat exchanger 82, as best shown in FIG. 5. An end of the conductive tubing 78 extends into the bottom of the spout 42.

Figure 6:
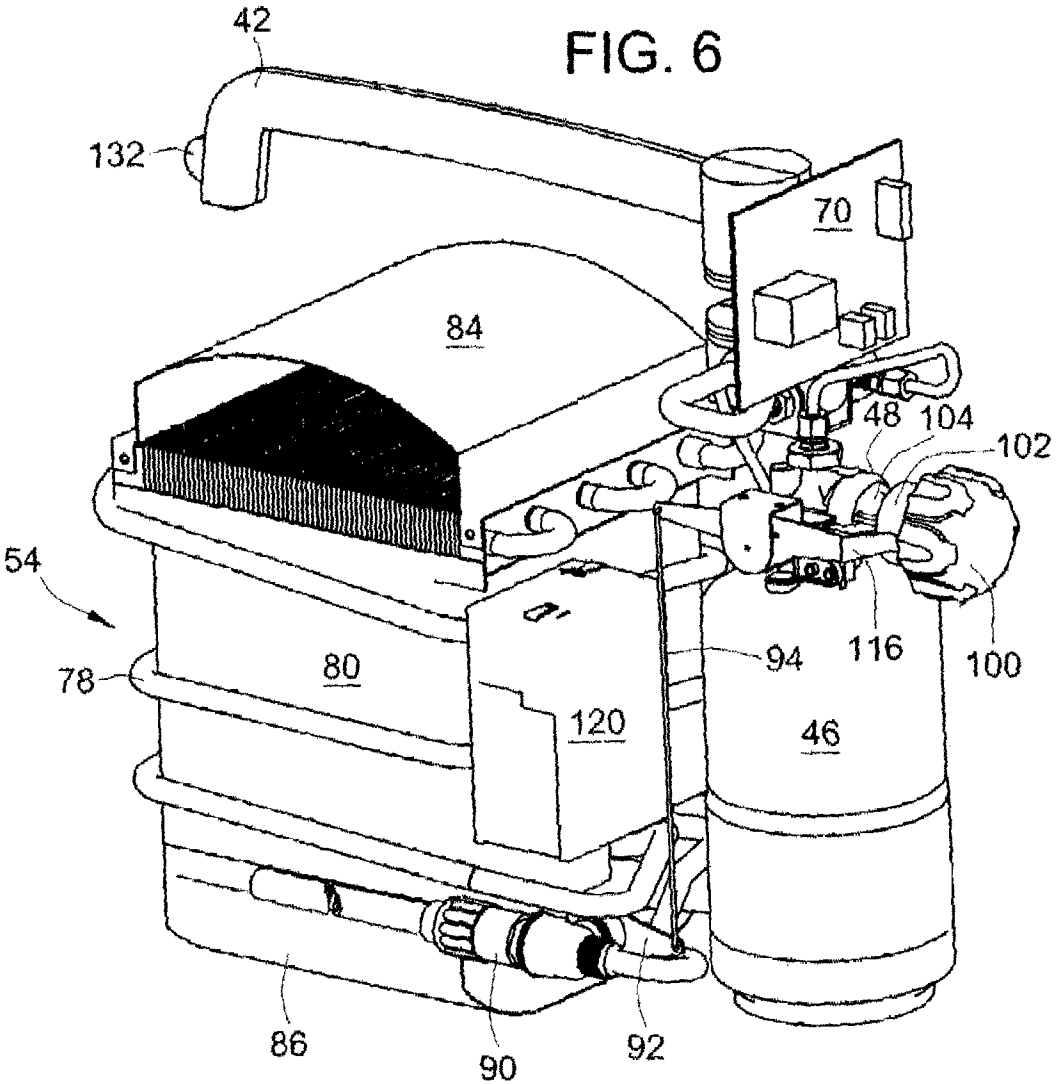
FIG. 6 is a left front, isometric view of the instant hot water heater of FIG. 1, with parts removed for detail.
Figure 7:
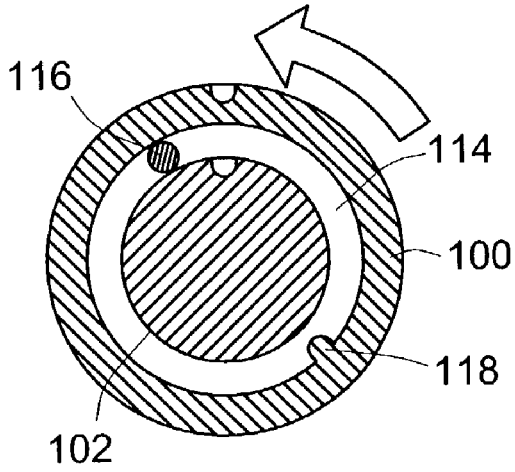
FIGS. 7–10 are diagrammatic representation of a cross-section of a control knob for use with the instant hot water heater of FIG. 1, the figures showing various stages of rotation of the control knob.

The opposite end of the conductive tubing 78 that leads from the pre-heater assembly 74 extends to a flow control valve 90 (best shown in FIG. 6). The flow control valve 90 is mounted to receive water from the pump 26 via the hose 24. The flow control valve 90 is in a normally open position and includes a rocker arm lever 92. A push rod 94 is connected to the rocker arm lever 92. The flow control valve 90 also includes a return spring (not shown, but known in the art) for biasing the flow control valve 90 in the open position, and a low flow stop (also not shown) to prevent complete closure of the flow control valve 90.

Details of the control knob 44 can be seen in FIG. 5. The control knob 44 includes an outer knob 100 and an inner knob 102. The outer knob 100 is mounted over and around the inner knob 102. The inner knob 102 is mounted on a regulator shaft 104 for the regulator 48. A torsion spring 106 fits between the inner knob 102 and the outer knob 100. The torsion spring 106 fits into a pocket (not shown) in the rear of the outer knob 100. Spring clip ends 110 of the torsion spring 106 fit into holes 112 on the inner knob 102 and outer knob 100 (the hole on the back of the outer knob is not shown, but is similar to the hole 112), respectively.

A gap 114 (FIGS. 7–10) is defined between the inner sidewall of the outer knob 100 and the outer sidewall of the inner knob 102. An end of a flow valve lever 116 (shown in full in FIG. 6, and a cross section of the end of which is shown in FIGS. 7–10) extends into the gap 114 between the inner knob 102 and the outer knob 100. The flow valve lever 116 is pivotably mounted to the base unit 22, for example to a side of the regulator 48. A forward end of the flow valve lever 116 extends outward toward the control knob 44 and bends at a first angle and then at a second angle so as to straighten back parallel to the rest of the flow valve lever 116. This end of the flow valve lever 116 is seated in the gap 114 between the inner knob 102 and the outer knob 100. The opposite end of the flow valve lever 116 is attached to the push rod 94 that in turn is attached to the rocker arm lever 92 of the flow control valve 90.

A protrusion 118 (FIGS. 7–10) is fixed on the inside surface of the outer knob is located in the gap between the outer knob 100 and the inner knob 102. When the control knob 44 is in a normally closed position, the protrusion 118 is located approximately halfway around the outer knob 100 from the flow valve lever 116. The function of the protrusion 118 is described further below.

Figure 11:
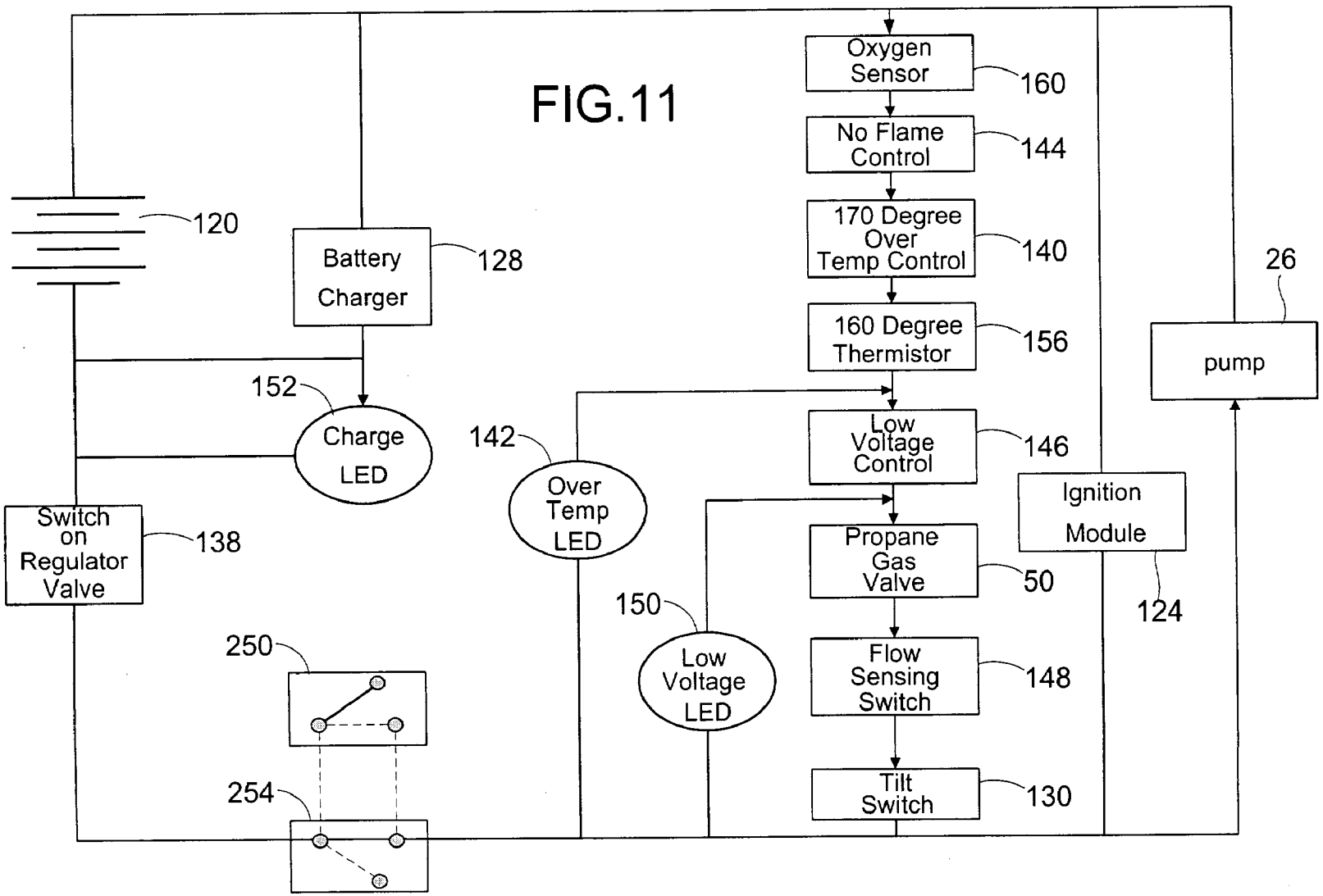
FIG. 11 is a schematic drawing of controls for the present invention.

A battery 120 is mounted in the base unit 22. The battery 120 is connected to the printed circuit board 70, the pump 26, an ignition module 124 (FIG. 11) for the burner 52, and the solenoid valve 50. If desired, the battery may include an integral or connected battery charger 128 (FIG. 11). If so, an AC or DC connector port 126 may be supplied on the outer shell of the base unit 22 for supplying power to the battery charger.

Operation of the instant hot water heater 20 may be understood with reference to the previous description and the circuit diagram at FIG. 11. To set up the instant hot water heater 20, a user disconnects the pump 26 from the snap ring 33 and unwinds the hose 24 from around the bottom of the base unit 22. The coupling 32 on the pump 26 is attached to a water source, such as the reservoir 28. Alternatively, the garden hose adapter 200 and a hose or water faucet (e.g., the garden hose 202) may be attached to the base unit 22. Preferably, the instant hot water heater 20 is placed on a level surface. By doing so, a flame in the burner 52 extends upward to the heat exchanger 82, and there is no risk of overheating the wrong components in the instant hot water heater 20. To this end, a tilt sensor or switch 130 (FIG. 11) may be provided that is in a normally closed position, and that when the base unit 22 is not within a particular range of being level (e.g., +/−20 degrees), the switch is closed.

Figure 4:
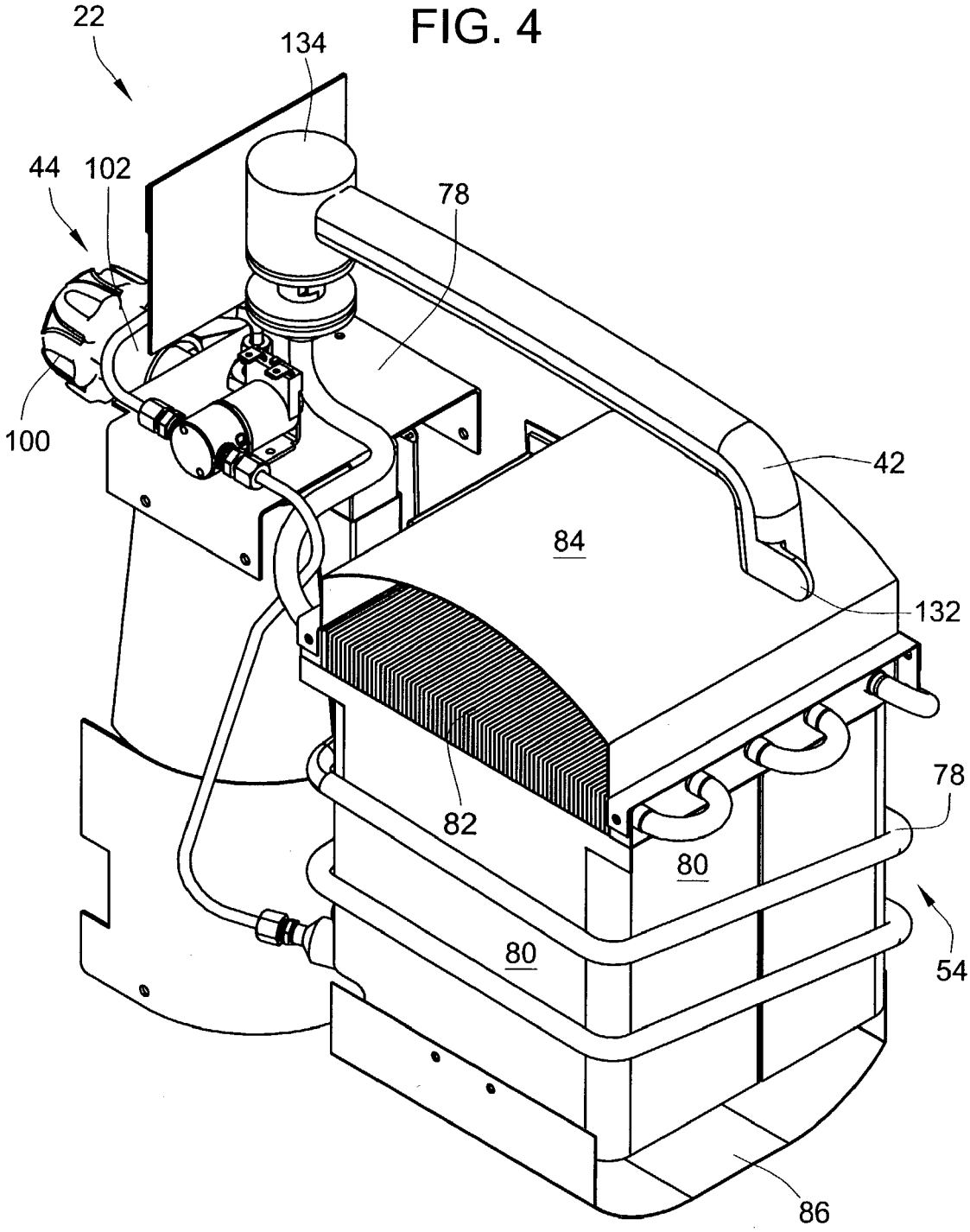
FIG. 4 is a rear right, isometric view of the instant hot water heater of FIG. 1, with parts removed for detail.

In any event, after the base unit 22 and the pump 26 are ready, the user rotates the spout 42 out of the handle 40. If desired, a detente 132 (FIG. 3) or other catch may be provided on the end of the spout 42 for fitting into a gap 133 on the handle 40. The spout may otherwise be temporarily locked into the handle 40. To permit the spout 42 to rotate without breaking the connection of the spout with the tubing 78, the spout 42 may be mounted on an appropriate rotator piece 134 (FIG. 4). Rotating connections that allow fluid to flow therethrough are well known, and a detailed description is not provided here so as not to obfuscate the invention. However, in one embodiment, the rotator piece 134 may be fixed to the spout 42, and the tubing 78 below the spout may be flexible. The spout 42 rotates within a slot 136 on the outside of the base unit 22 until it extends outward as shown in FIG. 1.

After the spout 42 has been rotated outward, the user actuates the control knob 44 by grasping the outer knob 100 and rotating it counterclockwise. A sequence of different stages of movement of the control knob 44 is shown in FIGS. 7–10. In the first half turn of the outer knob 100 (movement from FIG. 7, through FIG. 8, to FIG. 9), the inner knob 102 turns with the outer knob 100. The flow valve lever 116 does not move during this rotation, but instead stays stationary in the same position within the gap 114. In the first quarter of the movement (FIG. 7 to FIG. 8), a switch 138 (FIG. 11) in the regulator shaft 104 turns on the pump 26 and the printed circuit board 70. Alternatively, if the garden hose adapter 200 is used, the switch 138 turns on the solenoid valve 214 and the printed circuit board 70. Supplying power to the solenoid valve 214 opens the valve, allowing water to flow from the garden hose adapter 200 at the pressure set by the pressure regulator 218 (e.g., 4 p.s.i.).

During the first two portions of the movement of the control knob 44 (i.e., in the embodiment described, movement from FIG. 7 to FIG. 9), water flows unimpeded through the flow control valve 90. In the first quarter of a turn, the water flows through without being heated. A user will usually move quickly through this portion of movement of the control knob to the second portion. Continued movement of the outer knob 100 past the first quarter turn and into the second portion of movement (i.e., beyond FIG. 8 toward FIG. 9) begins a supply of gas via the regulator 48 to the burner 52 and causes the ignition module 124 to fire.

Although the function, structure, and operation of the regulator 48 and the ignition module 124 are generally known, a general description is given here for the convenience of the reader. To start combustion in the burner 52, the control knob 44 is rotated, in this case in a counterclockwise direction, causing the regulator shaft 104 to rotate. Rotation of the regulator shaft 104 causes two things to happen. First, the rotation of the regulator shaft 104 opens a valve (not shown), permitting the release of propane from the propane tank 46 and into the burner 52. Second, rotation of the regulator shaft 104 causes the ignition module 124 to spark. The spark ignites the propane in the burner 52, causing combustion.

Turning the control knob 44 further counterclockwise in the second portion of movement (i.e., from FIG. 8 to FIG. 9) opens the valve even more, and increases the amount of propane supplied by the propane tank 46, thus increasing the size of the flame in the burner 52. Likewise, clockwise rotation of the control knob 44 while there is a flame in the burner 52 decreases the size of the flame. This flame adjustment may be used to increase or decrease the heat supplied to the heat exchanger assembly 54.

In the second quarter of a turn, the heat exchanger assembly is heated to the extent of the flame size in the heat exchanger assembly 54. Water flowing through the base unit 22 is heated by the heat exchanger assembly. The water flows from the flow control valve 90 through the conductive tubing 78 and around the copper plate 76. As the water flows around the copper plate 76, it is preheated before entering the heat exchanger 82. This preheating of the water prior to it entering the heat exchanger 82 increases the efficiency of heating of water by the heat exchanger assembly 54 and reduces the likelihood of condensation being formed as a result of heating the water. The conductive tubing 78 extending around the sides 80 of the heat exchanger assembly 54 provides additional heating of the water before it enters the heat exchanger 82, increasing the efficiency of the system.

In addition to the preheating effect provided by the copper plate 76, the copper plate minimizes radiated heat on the bottom of the base unit 22. The lower heat shield also enhances protection of the bottom of the base unit 22.

Figure 8:
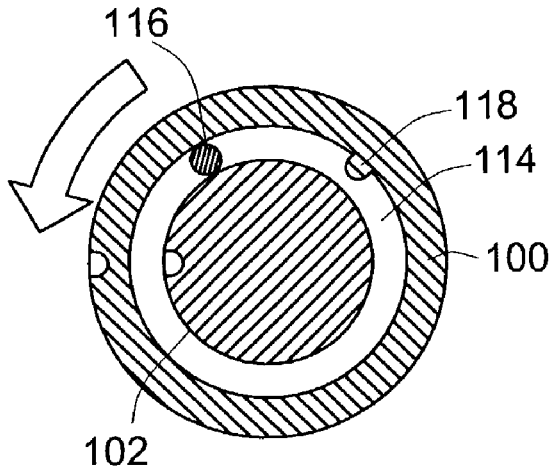
Figure 9:
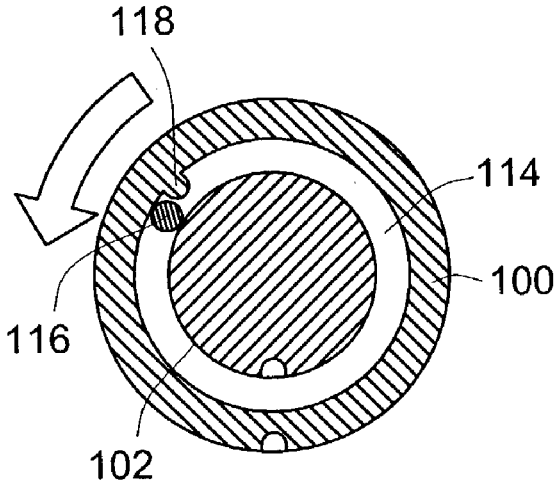
Figure 10:
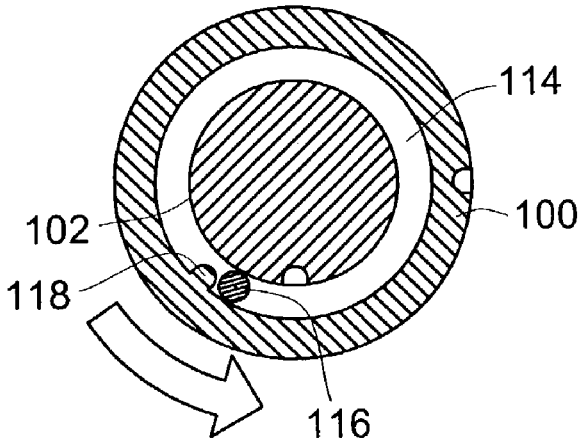

A user may find that water exiting the spout 42 is sufficiently heated when the control knob 44 is in the second range of movement (i.e., between FIG. 8 and FIG. 9). In this range of movement, the user may continue to rotate the knob in the counterclockwise direction, and doing so increases the burner flame, and the heat provided to the heat exchanger assembly 54 and the water flowing through the heat exchanger assembly. At the end of the second range of movement, the flame is at its maximum heat output, because the inner knob 102 cannot rotate any further because the regulator shaft 104 has hits the end of its range of rotation.

If the user wishes to increase the heat of the water even more, the user may continue to rotate the outer knob 100 past the half turn (i.e., counterclockwise beyond FIG. 9). Although the inner knob 102 cannot rotate any further, the user may continue to rotate the outer knob 100 against the action of the torsion spring 106. Simultaneous to the beginning of this movement, the protrusion 118 on the inside of the outer knob 100 engages the end of the flow valve lever 116 and begins to press it downward, driving the opposite end of the flow valve lever 116 upward, along with the push rod 94. When the push rod 94 is driven upward, the rocker arm lever 92 of the flow control valve 90 is also driven upward. This movement of the rocker arm lever 92 causes the flow control valve 90 to begin to restrict the flow of water into the base unit 22. The continued rotation of the outer knob 100 drives the end of the flow valve lever 116 down even further, from the position in FIG. 9 toward the position in FIG. 10, further closing the flow control valve 90. This movement may continue, for example for a 45 degree turn of the outer knob 100, until the flow control valve 90 reaches the low flow stop.

By decreasing the flow of water into the base unit 22, the amount of water that is heated by the heat exchanger unit 54 is decreased. Thus, the heat that is transferred per unit water is increased. As such, the temperature of the water exiting the spout 42 is increased. Although the volume of the water over a defined increment of time exiting the spout 42 would be decreased, the temperature of that water would be higher.

In summary, the control knob 44 provides several operations for the base unit 22 and the pump 26. A first portion of movement of the control knob 44 (in this embodiment, the first quarter turn) causes the pump 26 and the printed circuit 70 to be powered on. A second portion of the movement of the control knob 44 (in this embodiment, the second quarter turn) causes the burner 52 to be lit and adjust the length or output of the flame in the burner. A third portion of movement of the control knob 44 (e.g., a 45 degree turn after the first 90 degrees of motion) decreases the flow of water through the heat exchanger assembly 54, thus increasing the temperature of the water without adding additional heat output. The three different functions for the control knob 44 may be performed by more than one control, or may be performed by a single control that performs one or more of these operations in a different manner. For example, the first portion may be provided by pushing a control knob inward, the second portion by rotating the knob, and a third portion by continued rotation of the knob or movement of the knob downward. However, the described control knob 44 is advantageous in that using the same movement (i.e., rotation of the knob) a user may turn on the instant hot water heater and may be provided a desired temperature of water, without knowing how the operation has occurred, or, if the user turns the control knob into the third portion, that the flow of water has been limited. Other single movement control mechanisms may be used, such as by having a control knob that portions of movement in one direction (e.g., downward) performs each of the three portions of operation for the instant hot water heater 20.

In the embodiment shown, the second portion of operation by the control knob 44 provides a temperature delta of approximately 55° F. between inlet temperature of water and outlet temperature of water at the spout 42. Thus, if water enters the base unit 22 at 65° F., the outlet temperature of the water at spout 42 would be approximately 110° F. If warmer water temperature is desired, the water flow must be reduced. As described above, this operation is accomplished by turning the outer knob 100 into the third portion of operation of the control knob 44, which reduces the flow of water. The low flow stop prevents the flow of water from being so low that the unit would overheat.

The control system may include a device, such as a thermistor 156 (FIG. 8), for cycling on and off the propane gas valve 50. The thermistor 156 may, for example, turn off the propane gas valve 50 when a temperature hits 160 degrees Fahrenheit, and may turn the propane gas valve back on when the temperature hits 130. Operation of the thermistor 156 is further described below.

If desired, a safety over temperature control, which serves as a backup to the thermistor 156, may be provided. The safety over temperature control may be, for example, a 170° F. over temperature control 140 (FIG. 8) The over temperature control 140 may use a temperature sensing element, such as a thermistor to sense overheating of the heat exchanger assembly 54. The over temperature control 140 may alternatively sense the temperature of water exiting the spout 42. The over temperature control 140 is in a normally closed position, and exceeding an upper limit (e.g., 170° F.) causes the control to open. If desired, an over temperature LED 142, which may be red, may be provided that is lit when the over temperature control opens to shut off the propane gas valve 50.

Other controls may be provided to protect the base unit 22. For example, a no flame control 144, a low voltage control 146, and a flow sensing switch 148 may all be provided for safety of the base unit 22. As further described below, the flow sensing switch 148 may determine whether an adequate supply of water is flowing through the base unit 22, the low voltage control 146 may determine whether there is adequate voltage to operate the base unit 22 and the pump 26, and the no flame control 144 may sense whether a flame is operational in the heat exchanger unit 54. For the diagram shown in FIG. 11, each of these switches is in a normally closed position, and opening the switch causes the propane gas valve 50 to lose power and close, shutting off flow of gas to the burner 52. If desired, one or more LEDs, such as a low voltage LED 150 may be provided for indicating conditions of the base unit 44.

If desired, an oxygen sensor 160 (FIG. 11) may be provided for sensing oxygen in the environment of the base unit 22. The oxygen sensor 160 may be configured so that as long as oxygen is above a threshold, such as above 18% per volume, the oxygen sensor 160 is in a normally closed position. However, if oxygen falls below 18%, the oxygen sensor 160 may turn off the propane gas valve 50, perhaps after a delay. In this manner, the oxygen sensor 160 may prevent prolonged usage of the base unit 22 in a closed area, such as inside a closed room or a closed space. Otherwise, the base unit 22 may cause a depletion of oxygen for a user in the vicinity of the base unit 22.

The instant hot water heater 20 may also include an optional foot switch 250 (FIG. 12). The foot switch 250 may connect via a cord 252 to the base unit 22, and is configured so that a user may actuate the foot switch by pressure applied via a foot.

As can be seen in FIG. 11, if the optional foot switch 250 is enabled, a normally closed switch 254 may be provided in the circuit for the instant hot water heater 20. The normally closed switch 254 is closed when the foot switch 250 is not connected to the base unit 22. However, when the foot switch 250 is connected to the base unit 22, for example via a prong (not shown) inserted into a hole (also not shown) on the base unit 22, then the connection of the foot switch 250 may open the normally closed switch 254, for example by mechanically opening the normally closed switch via the prong connector, or by shorting an electrical connection that keeps the normally closed switch in the closed position.

When the foot switch 250 is connected to the base unit 22, it resides in section of the circuit in which the normally closed 254 normally resides. That is, the circuit routes through the foot switch 250 instead of the normally closed switch 254. The foot switch 250 includes a normally open switch therein, and actuation by a foot of the user, such as by stepping on the foot switch 250, closes the circuit.

To use the foot switch 250, a user attaches the foot switch 250 to the base unit 22 so as to open the normally closed switch 254. The user may then set the control knob 44 as desired, but because the circuit is opened through the foot switch 250, the unit does not operate. However, if the user steps on the foot switch 250, then operation of the pump 26 and the base unit 22 begins. In this manner, a user may utilize the foot switch 250 so that hands-free operation of the instant hot water heater 20 is enabled.

The printed circuit board 70 may include the necessary control components to operate the functions of the instant hot water heater 20. The printed circuit board 70 may be alternatively be standard control (i.e., a device or mechanism used to regulate or guide the operation of a machine, apparatus, or system), a microcomputer, or any other device that can execute computer-executable instructions, such as program modules. Generally, program modules include routines, programs, objects, components, data structures and the like that perform particular tasks or implement particular abstract data types. A programmer of ordinary skill in the art can program or configure the printed circuit board 70 to perform the functions described herein.

Figure 14:
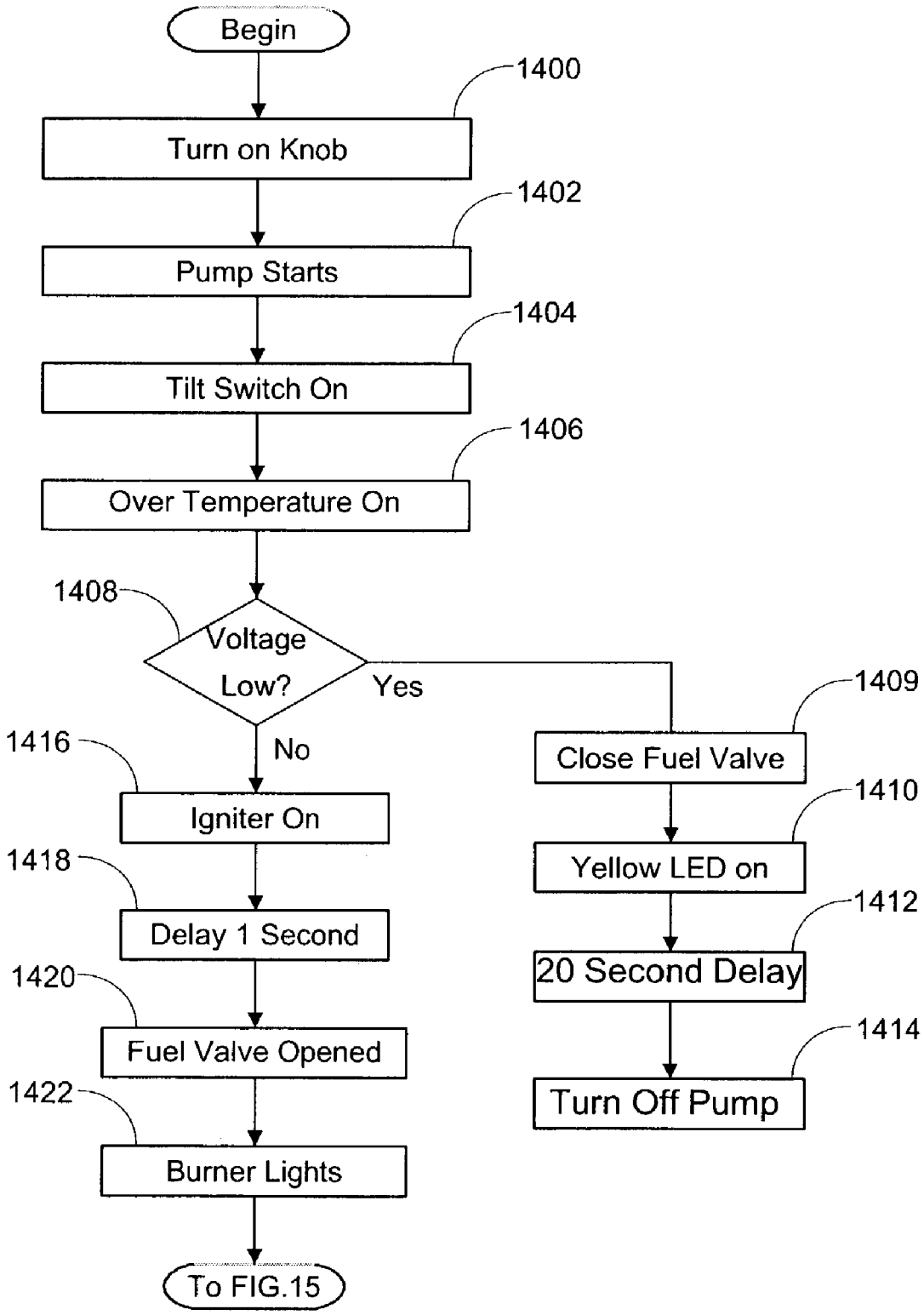
FIGS. 14 and 15 show exemplary steps for operation of the instant hot water heater of FIG. 1 in accordance with an embodiment of the present invention.
Figure 15:
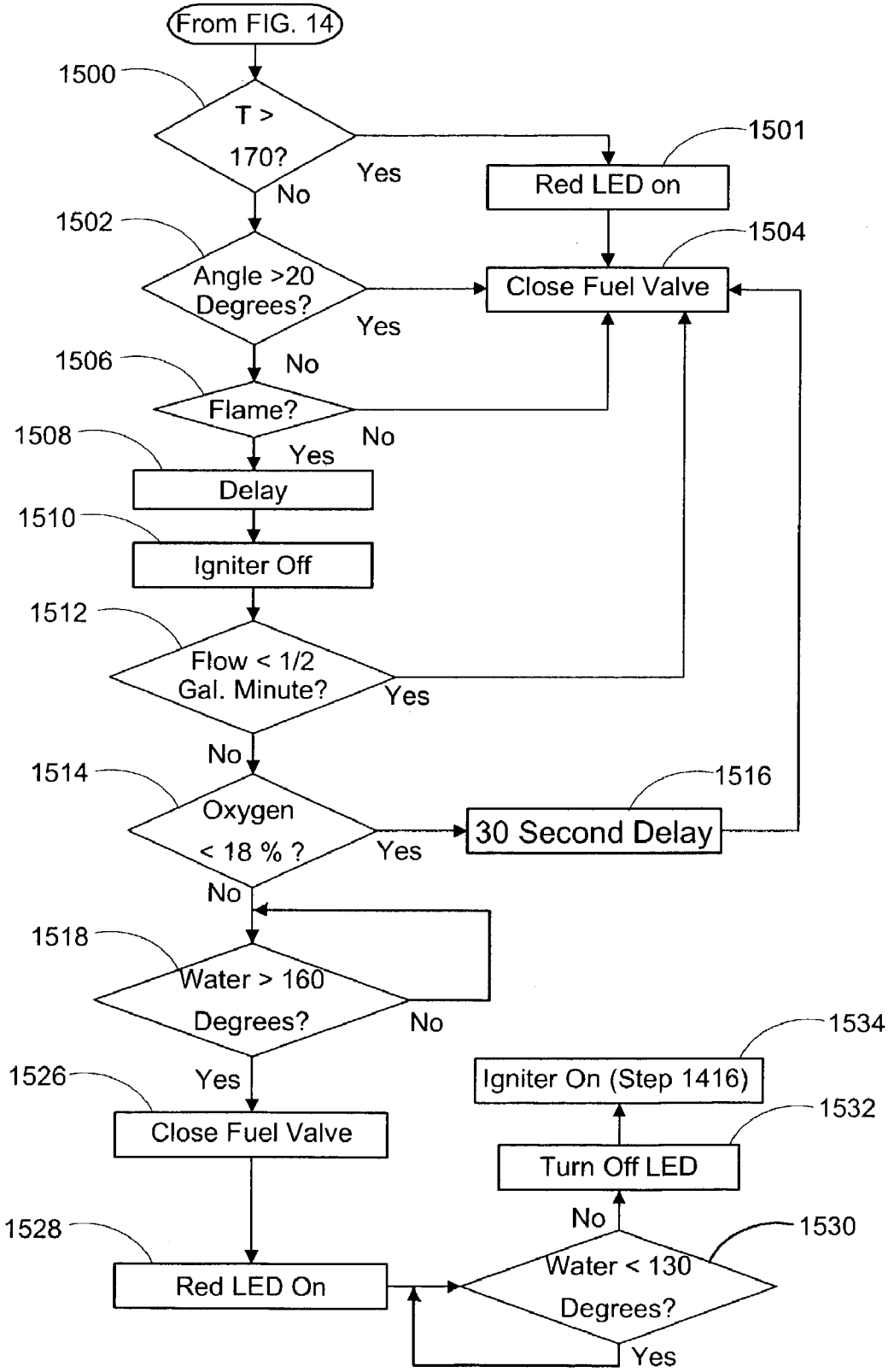

FIG. 14–15 show exemplary operation of the instant hot water heater 20 in accordance with one embodiment of the present invention. For many of the steps shown in FIGS. 14 and 15, the operation or step may be real time, in that if a particular decision occurs at any point in operation, the resultant step may occur. For example, if, during any point in operation of the instant hot water heater 20, the over temperature control 140 or another temperature sensor senses that the temperature of the water is over 170 degrees Fahrenheit, the propane gas valve 50 may be closed. However, in order to simplify description of the operation of the instant hot water heater 20, the steps are set forth as shown in FIGS. 14 and 15.

Beginning at step 1400, a user turns on the control knob 44. At step 1402, the pump 26 starts. At step 1404, the tilt switch 130 is turned on. At step 1406, the over temperature control 140 is turned on.

At step 1408, the low voltage control 146 determines whether the voltage for the instant hot water heater 20 is low. If so, step 1408 branches to step 1409, where the fuel valves closes, and then to step 1410, where the yellow low voltage LED 150 is lit. After a 20 second delay in step 1412, the pump 26 is turned off at step 1414. If the low voltage control 146 does not sense that the voltage is low, then step 1408 branches to step 1416, where the ignition module 124 is turned on. At step 1418 there is a one second delay and then the propane gas valve 50 is opened in step 1420. In preferred operation, the burner 52 lights in 1422. The process then proceeds to FIG. 15.

At step 1500, the over temperature control 140 determines whether the temperature of water exiting the instant hot water heater 20 exceeds a threshold, for example, 170 degrees Fahrenheit. If so, step 1500 branches to step 1504, where the propane gas valve 50 is closed. Alternatively, in this step and other instances where closing of the propane gas valve 50 is referenced, the microcontroller may handle differently, such as by lowering output of the burner 52, increasing flow rate from the pump 26, or otherwise adjusting the instant hot water heater 20 to safely handle the sensed situation.

In any event, if the temperature threshold is not exceeded, then step 1500 branches to step 1502, where the tilt switch 130 determines whether the angle is greater than 20 degrees. If the angle is greater than 20 degrees, then step 1502 branches to step 1504, where the propane gas valve 50 is closed. If the angle is not greater than 20 degrees, then step 1502 branches to step 1506, where a determination is made by the no flame control 144 whether a flame is present in the burner 52. If not, then step 1506 branches to step 1504, where the propane gas valve 50 is closed. If a flame is present in the burner 52, then step 1506 branches to step 1508 where a delay, such as 3 seconds, occurs, and then the ignition module 124 is turned off in step 1510.

The process then proceeds to step 1512, where a determination is made whether the flow rate of water through the instant hot water heater 20 is less than a threshold, for example, one half gallon per minute. This determination may be made, for example, by the flow sensing switch 148. If the flow rate is less than one half gallon per minute, then step 1512 branches to step 1504, where the propane gas valve 50 is closed. If the flow rate is greater than one half gallon per minute, then step 1512 branches to step 1514, where the oxygen sensor 160 determines whether the oxygen in the adjacent air is greater than 18% per volume. If the oxygen is not greater than 18% per volume, then after a 30 second delay in step 1516, the propane gas valve 50 is closed at step 1504.

If the oxygen is greater than 18%, then step 1514 branches to step 1518, where the beginning of operation of the thermistor 156 is shown, continuing through step 1534. At step 1518, a determination is made if the water temperature in the base unit 22 is greater than 160 degrees Fahrenheit. If the water is not greater than 160 degrees, then the process branches back until the burner 52 causes the water to exceed 160 degrees. The water may never exceed 160 degrees, and the process may continue the loop at step 1518.

If the water does exceed 160 degrees, then step 1518 branches to step 1526, where the propane gas valve 50 is closed. A red LED (e.g., the LED 142) may be lit to indicate that the propane gas valve 50 has been closed and that the burner 52 is not operating at step 1528. The process then proceeds to step 1530, where a determination is made whether the water exceeds 130 degrees. If it does exceed 130 degrees, then the process loops back onto itself until the water drops below 130 degrees. When the water drops below 130 degrees, the red LED 142 is turned off in step 1532, and then the ignition module 124 is turned back on in step 1534, and the process returns to step 1460.

In the described embodiment, it takes about three seconds for heated water to come out of the spout 42 after a user begins operation of the instant hot water heater 20. There is control of the water temperature that exits the spout 42 from inlet temperature to approximately 150° F. To provide this heat of water, the regulator is adjustable from zero fuel to 30,000 Btus. In addition, the flow control valve 90 is adjustable from one gallon per minute to ½ gallon per minute.

For the described embodiment, a single 16 oz. propane cylinder can produce around 40 gallons of heated water, assuming the flow control valve 90 is not limiting the flow of water. If desired, a user may connect the base unit 22 to a 20 lb. propane cylinder with a hose so that extended use may be provided.

The instant hot water heater 20 provides varying degrees of hot water instantaneously. The instant hot water heater 20 can be transported and may be used in all locations, such as for camping or tailgating, and may be used for many applications including washing dishes, food preparation, making coffee and tea, and washing face and hands.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

What is claimed is:

1. An instant hot water heater, comprising:

a base unit;

a heat exchanger in the base unit for heating water;

a combustion device for heating the heat exchanger; and a control system for effecting safe operation of the base unit, wherein the control system comprises an oxygen sensor that provides a signal if an oxygen level for the instant hot water heater falls below approximately 18% Oxygen by volume.

2. The instant hot water heater of claim 1, wherein the signal is used to stop operation of the combustion device.

3. An instant hot water heater, comprising:

a base unit;

a heat exchanger in the base unit for heating water;

a combustion device for heating the heat exchanger;

a control system for effecting safe operation of the base unit, wherein the control system comprises:

an oxygen sensor that provides a signal if an oxygen level for the instant hot water heater falls below a defined threshold; and a tilt sensor that detects an angle at which the base unit is resting, and which provides a signal if the base unit the angle is outside a threshold.

4. The instant hot water heater of claim 3, wherein the signal is used to stop operation of the combustion device.

5. An instant hot water heater, comprising:

a portable base unit for heating water, the base unit comprising a handle for carrying the base unit;

a foot pedal switch for turning on and off operation of the base unit; and a control for operating the base unit, the control being capable of operating the base unit independent of the foot pedal when the foot pedal is not attached to the base unit.

6. The instant hot water heater of claim 5, wherein actuation of the foot switch is required to operate the base unit when the foot switch is attached to the base unit.

7. An instant hot water heater, comprising:

a base unit for heating water;

a foot pedal for controlling operation of the base unit;

a control for operating the base unit, wherein the control is capable of operating the base unit independent of the foot pedal when the foot pedal is not attached to the base unit and wherein actuation of the foot pedal is required to operate the base unit when the foot pedal is attached to the base unit.

* * * * *